US009776782B2

(12) United States Patent
Klipstine

(10) Patent No.: US 9,776,782 B2
(45) Date of Patent: Oct. 3, 2017

(54) OVERWRAP WITH INTEGRAL LIDDING FILM

(71) Applicant: BEMIS COMPANY, INC., Neenah, WI (US)

(72) Inventor: Keith A. Klipstine, Appleton, WI (US)

(73) Assignee: Bemis Company, Inc., Neenah, WI (US)

( * ) Notice: Subject to any disclaimer, the term of this patent is extended or adjusted under 35 U.S.C. 154(b) by 0 days.

(21) Appl. No.: 15/036,677

(22) PCT Filed: Jan. 21, 2014

(86) PCT No.: PCT/US2014/012245

§ 371 (c)(1),
(2) Date: May 13, 2016

(87) PCT Pub. No.: WO2015/112110

PCT Pub. Date: Jul. 30, 2015

(65) Prior Publication Data

US 2016/0280441 A1 Sep. 29, 2016

(51) Int. Cl.
*B65D 77/00* (2006.01)
*B65D 75/58* (2006.01)
(Continued)

(52) U.S. Cl.
CPC ..... *B65D 77/003* (2013.01); *B65D 65/40* (2013.01); *B65D 75/5833* (2013.01);
(Continued)

(58) Field of Classification Search
CPC ..... B65D 65/00; B65D 65/02; B65D 65/04; B65D 65/06; B65D 65/10; B65D 65/12;
(Continued)

(56) References Cited

U.S. PATENT DOCUMENTS 3,650,775 A 3/1972 Simon et al.
4,268,738 A 5/1981 Flautt, Jr. et al.
(Continued)

FOREIGN PATENT DOCUMENTS

WO 9609967 4/1996
WO 9935039 7/1999
(Continued)

*Primary Examiner* — Bryon Gehman
(74) *Attorney, Agent, or Firm* — Amy L. De Coster

(57) ABSTRACT

The present invention relates to improved packages which include a rigid or semi-rigid tray having a single thermoplastic overwrap comprising a polymeric laminate surrounding the tray and having a front panel and an opposing back panel. The inventive packages also include a continuous seal circumscribing a recessed cavity of the tray which comprises a heat seal formed by heat sealing a portion of the front panel to the peripheral flange of the tray. Advantageously, when the tray is removed from the overwrap, a portion of the first film separates from the laminate and remains peelably sealed to the flange of the tray and thus, may serve as a lidding film for the container. Since the recessed cavity is still covered, the container may then be placed directly in a microwave or conventional oven to thaw and/or cook the food container within the package without first removing the lidding film.

20 Claims, 14 Drawing Sheets

(51) Int. Cl.

| | |
|---|---|
| ***B65D 77/20*** | (2006.01) |
| ***B65D 65/40*** | (2006.01) |
| ***B65D 79/00*** | (2006.01) |
| ***B65D 81/34*** | (2006.01) |

(52) U.S. Cl.
CPC ..... *B65D 75/5855* (2013.01); *B65D 77/204* (2013.01); *B65D 79/005* (2013.01); *B65D 81/3461* (2013.01)

(58) Field of Classification Search
CPC .... B65D 65/40; B65D 65/403; B65D 65/406; B65D 75/30; B65D 75/58; B65D 75/5833; B65D 75/5855; B65D 77/00; B65D 77/003; B65D 77/20; B65D 77/204; B65D 79/00; B65D 79/005; B65D 81/34; B65D 81/3453; B65D 81/3461; B65D 85/00
USPC ..... 206/484–484.2; 426/115–124
See application file for complete search history.

(56) References Cited

U.S. PATENT DOCUMENTS

| | | | | |
|---|---|---|---|---|
| 4,483,125 | A | 11/1984 | Suga | |
| 4,548,852 | A * | 10/1985 | Mitchell | B65D 77/003 383/103 |
| 4,625,495 | A | 12/1986 | Holovach | |
| 4,703,148 | A | 10/1987 | Mikulski et al. | |
| 4,786,513 | A | 11/1988 | Monforton et al. | |
| 4,874,620 | A | 10/1989 | Mendenhall et al. | |
| 4,939,332 | A | 7/1990 | Hahn | |
| 5,039,001 | A * | 8/1991 | Kinigakis | B65D 81/3453 220/359.3 |
| 5,229,180 | A | 7/1993 | Littmann | |
| 5,667,827 | A * | 9/1997 | Breen | B65D 77/003 426/108 |
| 5,686,126 | A | 11/1997 | Noel et al. | |
| 5,779,050 | A | 7/1998 | Kocher et al. | |
| 5,919,547 | A | 7/1999 | Kocher et al. | |
| 5,958,484 | A | 9/1999 | Gics | |
| 6,630,237 | B2 | 10/2003 | Rivett et al. | |
| 7,344,744 | B2 * | 3/2008 | Sierra-Gomez | B65D 77/003 229/87.08 |
| 7,476,830 | B2 | 1/2009 | Middleton et al. | |
| 7,541,562 | B2 | 6/2009 | Cole et al. | |
| 7,608,317 | B2 | 10/2009 | Keckeisen et al. | |
| 8,057,832 | B2 * | 11/2011 | Forneck | B65D 81/3453 426/106 |
| 8,087,827 | B2 * | 1/2012 | Mir | B65D 81/34 426/118 |
| 8,302,528 | B2 | 11/2012 | Pawlick et al. | |
| 8,354,131 | B2 * | 1/2013 | Gan | B65D 81/3453 426/106 |
| 2008/0063759 | A1 * | 3/2008 | Raymond | B65D 81/3453 426/127 |
| 2008/0063760 | A1 * | 3/2008 | Raymond | B65D 81/3453 426/127 |
| 2009/0242550 | A1 | 10/2009 | Schneider | |
| 2013/0114918 | A1 | 5/2013 | Lyzenga et al. | |

FOREIGN PATENT DOCUMENTS

| | | | |
|---|---|---|---|
| WO | 0119702 | A1 | 3/2001 |
| WO | 2005077783 | A1 | 8/2005 |
| WO | 2011146627 | A1 | 11/2011 |
| WO | 2012166381 | A1 | 12/2012 |

* cited by examiner

OVERWRAP WITH INTEGRAL LIDDING FILM

BACKGROUND OF THE INVENTION

The present invention relates to packages including a tray surrounded by a single thermoplastic overwrap and particularly to ovenable packages having a single peelable thermoplastic overwrap heat sealed to the tray that provides a lidding film which separates from the overwrap and remains peelably sealed to the flange of the tray when the tray is removed from the overwrap.

Various concerns arise in connection with the manufacture and use of food and non-food packages. One area of concern is with respect to the cost of packaging components and the efficiency that they are assembled with the food items. For example, current packaging containers for microwavable meals include a tray on which a food item is supported and a separate plastic lidding film which is heat sealed to the rim of the tray to seal the food item within the package. The lidding film is normally sealed to the container in order to prevent leakage of fluids from within the container and also prevent ingress and egress of gases into and out of the container. Lidding films also help retain the moisture content, nutritional value, flavor, texture and appearance of the food. A lidding film is often used to cover a tray in microwave packages to prevent food from splattering inside the oven and helps to control the temperature inside the package during the heating process. Typically, a separate paperboard sleeve-type overwrap or paperboard carton is required which surrounds the sealed tray and provides a surface for product information and/or cooking instructions. It would be highly desirable to minimize the cost of the packaging components by eliminating the paperboard sleeve-type overwrap or paperboard carton.

There is a need in the art for improved packages that address at least some of the above concerns, and which are simple in construction, can be made easily and inexpensively manufactured.

BRIEF SUMMARY OF THE INVENTION

The present invention is concerned with packages which include a rigid or semi-rigid tray having a base and at least one sidewall extending from the base thereby forming a recessed cavity; wherein the at least one sidewall comprises a peripheral flange extending generally perpendicularly from the at least one sidewall and which circumscribes the recessed cavity. The inventive packages also include a single thermoplastic overwrap comprising a polymeric laminate surrounding the tray and having a front panel and an opposing back panel having a longitudinal seal disposed underneath the base of the tray, a first leading end seal positioned substantially transverse to the longitudinal seal, and an opposing second trailing end seal positioned substantially transverse to the longitudinal seal. The overwrap further includes an exterior surface and an interior surface, a first side edge, an opposing second side edge, a front panel and an opposing back panel comprising a longitudinal seal, a first leading end seal positioned substantially transverse to said longitudinal seal, and an opposing second trailing end seal positioned substantially transverse to the longitudinal seal The packages also include a peelable seal continuously circumscribing the recessed cavity which comprises an inner perimeter defined by a heat seal formed by heat sealing a portion of the front panel to the peripheral flange. The packages further comprise a first film integrally formed in polymeric laminate which forms the interior surface of the overwrap, and a second film also integrally formed in the laminate which forms the exterior surface of the overwrap.

Advantageously, when the tray is removed from the overwrap, a portion of the first film separates from the laminate and remains peelably sealed to the flange of the tray and thus, may serve as a lidding film for the container. Since the recessed cavity is still covered, the container may then be placed directly in a microwave or conventional oven to thaw and/or cook the food container within the package without first removing the lidding film. The consumer thus avoids having to handle the raw product or to clean a container in which the food would have otherwise been placed for heating or cooking. Because this portion of the first film is peelably affixed to the flange, the consumer may also simply dispose of the remaining film after heating or cooking the food by peeling the film away from the tray.

Optionally, the packages of the present invention are self-venting whereby a venting means permits the portion of the first film which separates from the laminate and remains peelably sealed to the flange of the tray when the tray is removed from the overwrap to rupture and release steam in response to heat and/or overpressure generated during heating of a food item in a microwave oven.

DETAILED DESCRIPTION OF THE INVENTION

The present inventions now will be described more fully hereinafter with reference to the accompanying drawings, in which some, but not all embodiments of the inventions are shown. Indeed, these inventions may be embodied in many different forms and should not be construed as limited to the embodiments set forth herein; rather, these embodiments are provided so that this disclosure will satisfy applicable legal requirements. Like numbers refer to like elements throughout.

Figure 1:
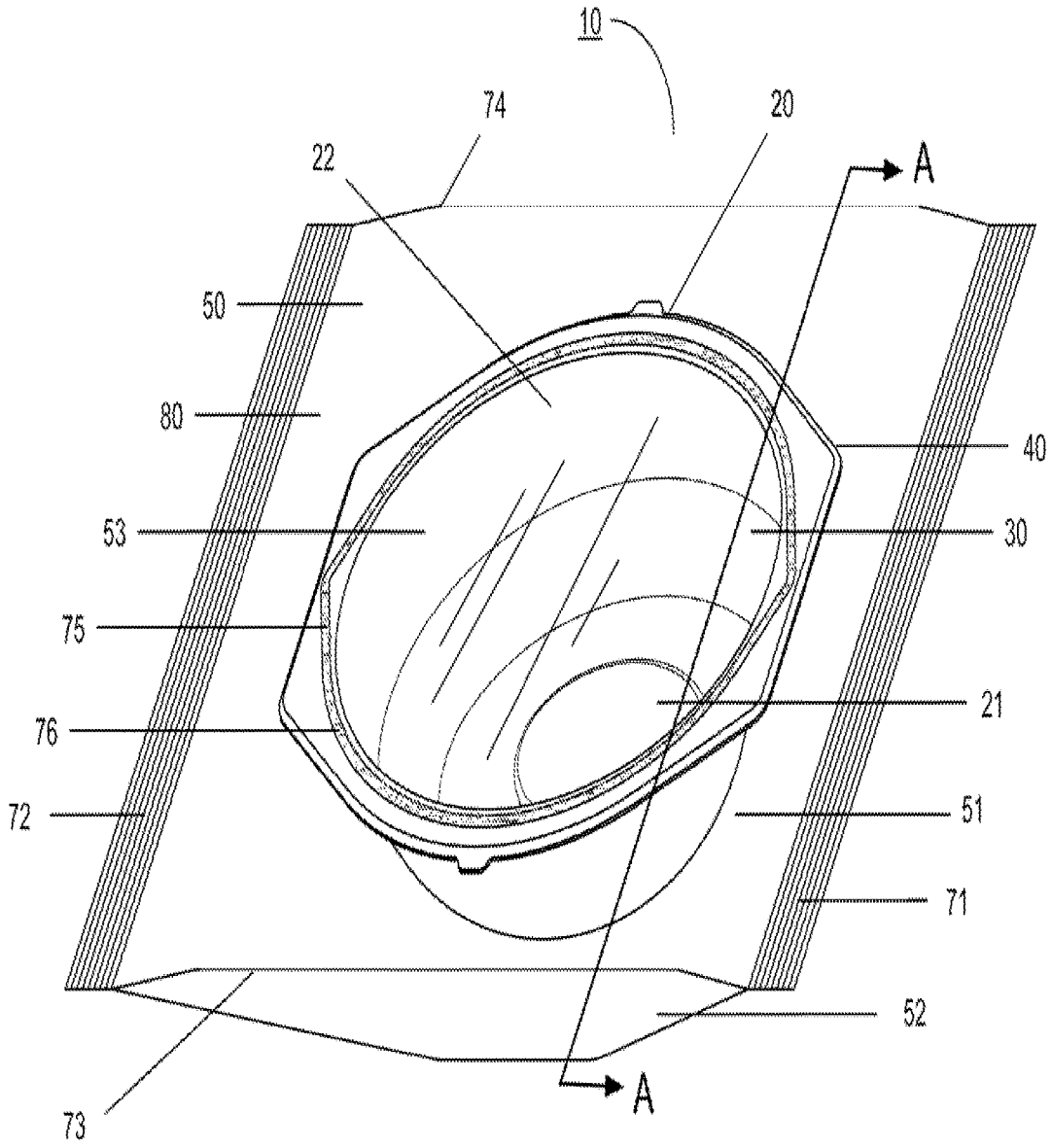
FIG. 1 depicts an isometric top perspective view f one preferred embodiment of the present invention.
Figure 2:
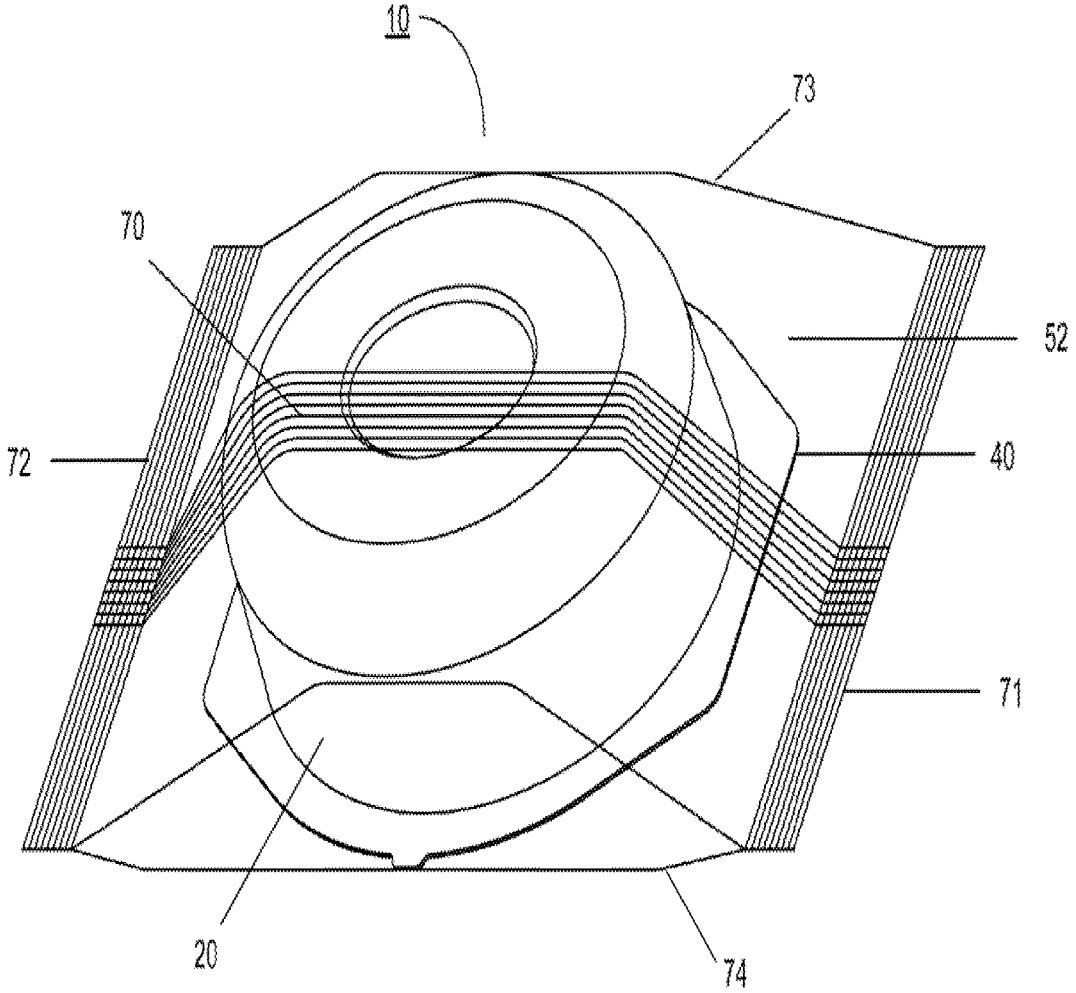
FIG. 2 depicts an isometric bottom perspective view of one preferred embodiment of the present invention.

Referring now more particularly to FIGS. 1-2 of the drawings, a preferred embodiment of package 10 embodying the present invention is shown. The package 10 comprises a rigid or semi-rigid tray 20 having a recessed cavity 30 and a peripheral flange 40 circumscribing recessed cavity 30. The tray 20 can be made of any suitable material, however, it is preferred that the tray 20 be made of a plastic that can withstand exposure to the heating and/or cooking environment of a microwave oven. Most preferably, the plastic is polypropylene or crystallized polyethylene terephthalate ("CPET") although other plastics, such as, amorphous polyethylene terephthalate ("APET") or polystyrene may be used. It should be recognized that tray 20 may also be formed from multilayer plastic films which provide an exterior heat sealable surface, and oxygen and/or moisture barrier properties. In a preferred embodiment of the present invention, tray 20 includes an exterior heat sealable surface which can be heat sealed to an overwrap.

The tray 20 has a base 21 and a sidewall 22 extending from the base 21 which forms recessed cavity 30. The sidewall 22 of tray 20 terminates at peripheral flange 40 which circumscribes recessed cavity 30. It will be appreciated that tray 20 may be of the shape as shown in FIGS. 1-2 or any other shape, such as, for example, rectangular, square, circular or polygon depending on both functional and aesthetic requirements. It will also be appreciated that tray 20 may have any depth as desired depending upon type and amount of food product container therein. It will be further appreciated that tray 20 may be configured to include two or more recessed cavities depending again on both functional and aesthetic requirements.

As depicted, a single thermoplastic overwrap 50 comprises a polymeric laminate 80 and encloses tray 20 and includes a front panel 51 and an opposing back panel 52 (shown in FIG. 2). Front panel 51 includes an inner surface and an outer surface. Back panel 52 is disposed underneath the base 21 of tray 20 and includes a longitudinal seal 70 (shown in FIG. 2). Preferably, longitudinal seal 70 is a heat seal or cold seal, and more preferably, a heat seal. Longitudinal seal 70 may be configured as either a fin seal or lap seal, and preferably as a fin seal. As used herein, the term "heat seal" refers to welding or melting of two polymeric surfaces together by the application of heat and pressure. It will be appreciated by those skilled in the art that heat seals may be hermetic seals meaning that they prevent the ingress of air and/or moisture through the seal. Thermoplastic overwrap 50 further comprises a first leading end seal 71 positioned substantially transverse to the longitudinal heat seal 70, an opposing second trailing end seal 72 positioned substantially transverse to the longitudinal seal 70, a first side edge 73, and an opposing second side edge 74. As depicted, first side edge 73 and an opposing second side edge 74 are each positioned between first leading end seal 71 and opposing second trailing end seal 72. Preferably, first leading end seal 71 and opposing second trailing end seal 72 are each a heat seal or cold seal, and more preferably, a heat seal. Preferably, first leading end seal 71 and opposing second trailing end seal 72 are each configured as a fin seal.

Front panel 51 includes a continuous peelable seal 75 which continuously circumscribes the recessed cavity 30 and comprises a perimeter defined by heat seal 76 formed by heat sealing a portion 53 of front panel 51 to the peripheral flange 40. It will be appreciated that this portion of front panel 51 covers recessed cavity 30 which then seals any food item within container 10. This reduces the cost of packaging by eliminating the need for a separate lidding film. Portion 53 also provides a relatively smooth surface for printing of indicia. Printing onto portion 53 may include graphics or colors to make package 10 more attractive to a potential consumer. Alternatively, portion 53 may be transparent and used for viewing of the food item contained within package 10 by a consumer. In addition, back panel 52 may be used to place other indicia, such as mandated by local food labeling laws, as well as, cooking instructions which may be desired to be placed on the package 10. In this way, the extra cost of a separate printed paperboard overwrap sleeve or a separate paperboard carton can now be eliminated by printing directly onto to front panel 51 and/or back panel 52 of package 10.

Thermoplastic overwrap 50 may comprise a material which will not melt or otherwise deteriorate during heating of the food items in a microwave oven. Preferably, thermoplastic overwrap 50 is constructed from a material that will sufficiently not retain heat to prevent discomfort or burning to the consumer upon handling following microwave cooking. It will be appreciated that the choice of materials used to form overwrap 50 may be determined by the nature of the food items to be packaged in the package 10. For example, packaging of refrigerated foods. overwrap 50 must by substantially impermeable to gases and/or water vapor. Packaging for refrigerated foods will often include oxygen barrier materials such as one or more layers of polyamide and ethylene vinyl alcohol copolymer. The constructions of the overwrap of the invention will be discussed in greater detail below.

Figure 3:
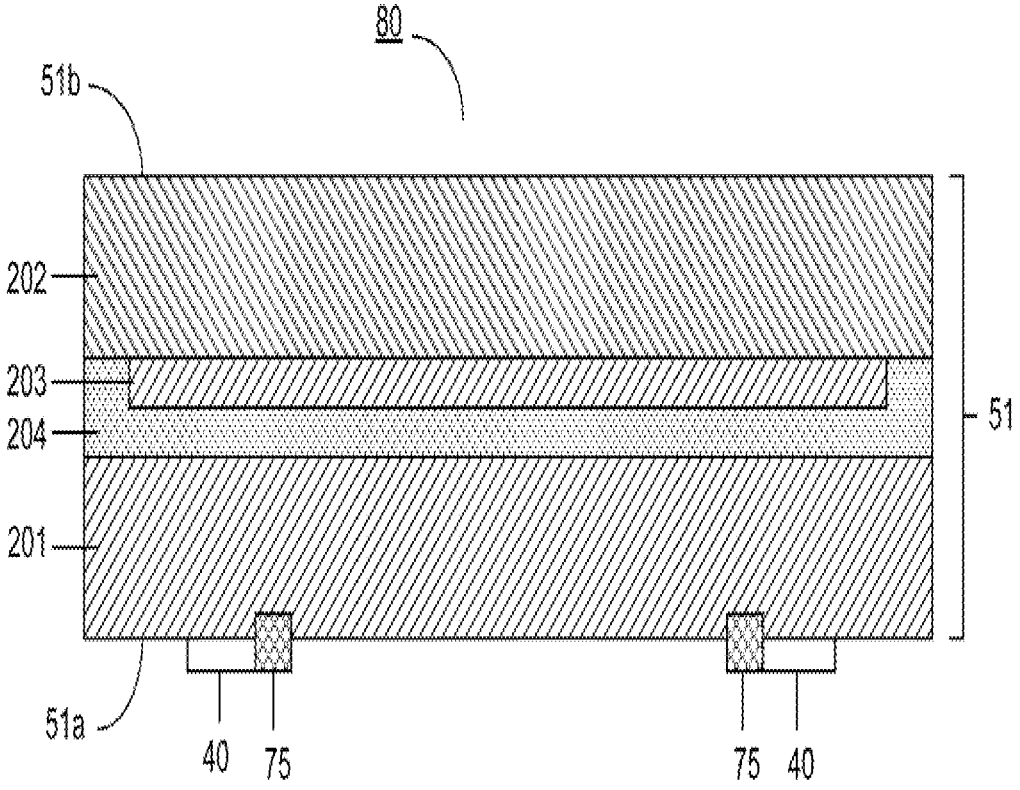
FIG. 3 depicts one embodiment of a thermoplastic overwrap of the present invention taken through section A-A of FIG. 1.

FIG. 3 is a cross-sectional view of an example of a preferred embodiment of a thermoplastic overwrap 50 comprising a polymeric laminate 80 heat sealed to tray 20 at flange 40 thereby creating a peelable seal 75. As depicted, laminate 80 includes a multilayer structure formed by lamination of a first film 201 to a second film 202 via an adhesive layer 204. As depicted, there is a release lacquer 203 printed in-register (or non-contiguously) on first film 201 such that release lacquer 203 is in direct contact with less than the entire surface of second film 202. Overwrap 50 will include an interior surface 51*a* and an exterior surface 51*b*.

Figure 4:
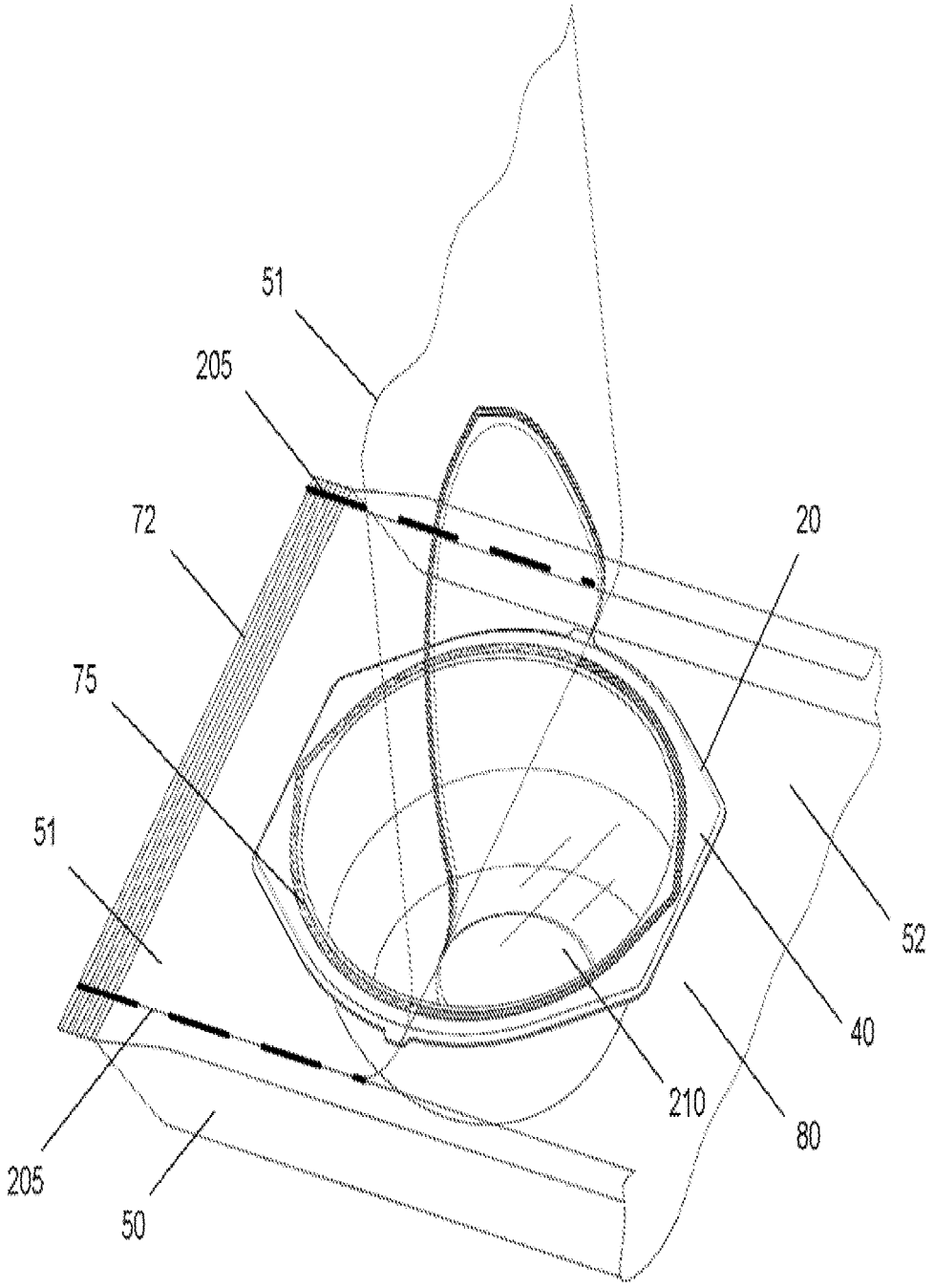
FIG. 4 depicts an isometric top perspective view of the present invention illustrating a portion of first film which separates from overwrap and remains peelable attached to the tray when removing the tray from the overwrap.

In accordance with an important aspect of the present invention, the removal of tray 20 from overwrap 50 may be achieved by tearing front panel 51 away from back panel 52 or cutting by across overwrap 50 near first leading end seal 71 with a pair of scissors. With front panel 51 separated from back panel 52, the consumer may simply grasp tray 20 and pull front panel 51 away from the tray, thereby separating a portion of first film 210 from laminate 80 which remains peelably sealed to flange 40 and functions as a lidding film thereafter as illustrated in FIG. 4. With the overwrap 50 removed and a lidding film 210 covering tray 20, the consumer may then place the tray inside a microwave oven to thaw and/or cook the food items as desired.

Figure 5:
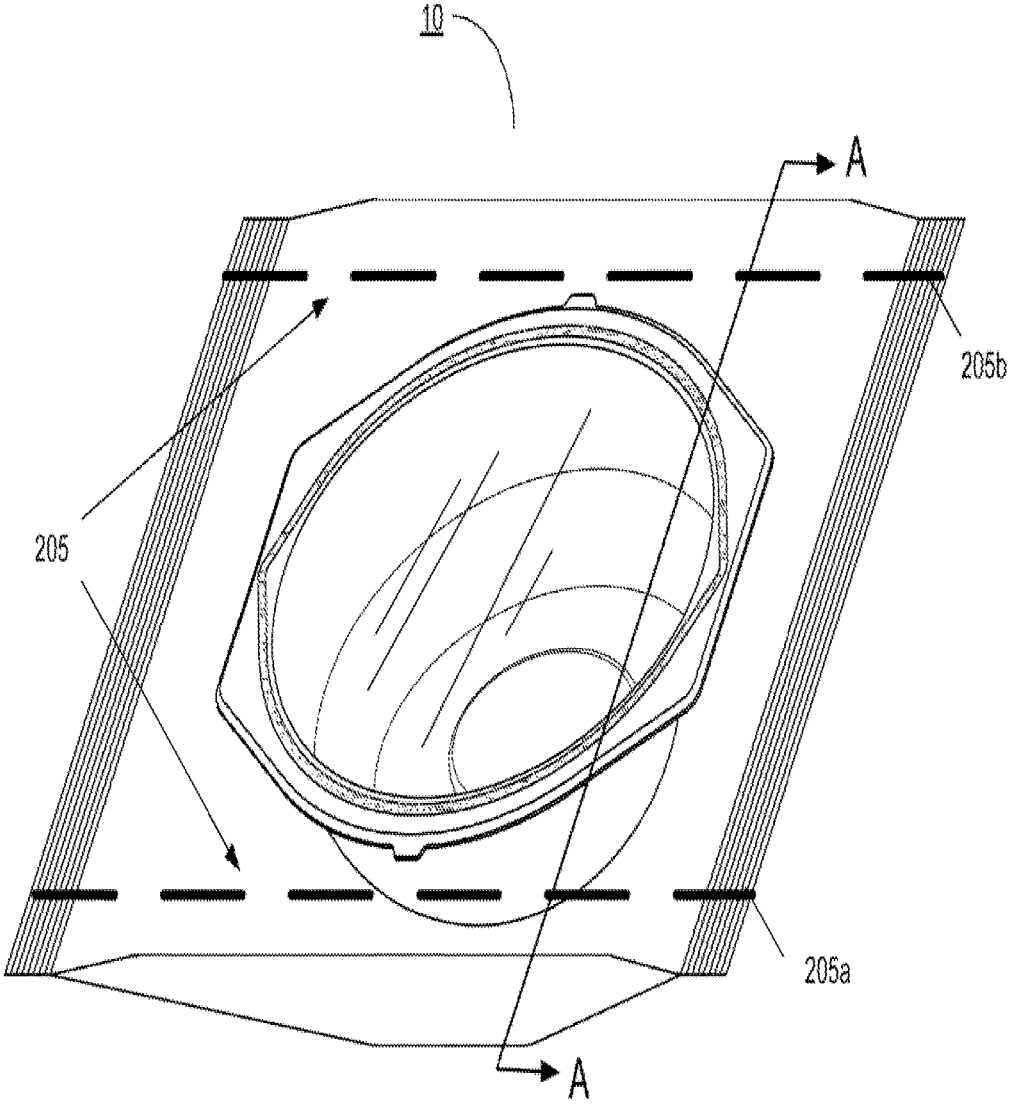
FIG. 5 depicts an isometric top perspective of a package of the present invention illustrating one embodiment of a pattern of perforations in a first film.
Figure 6:
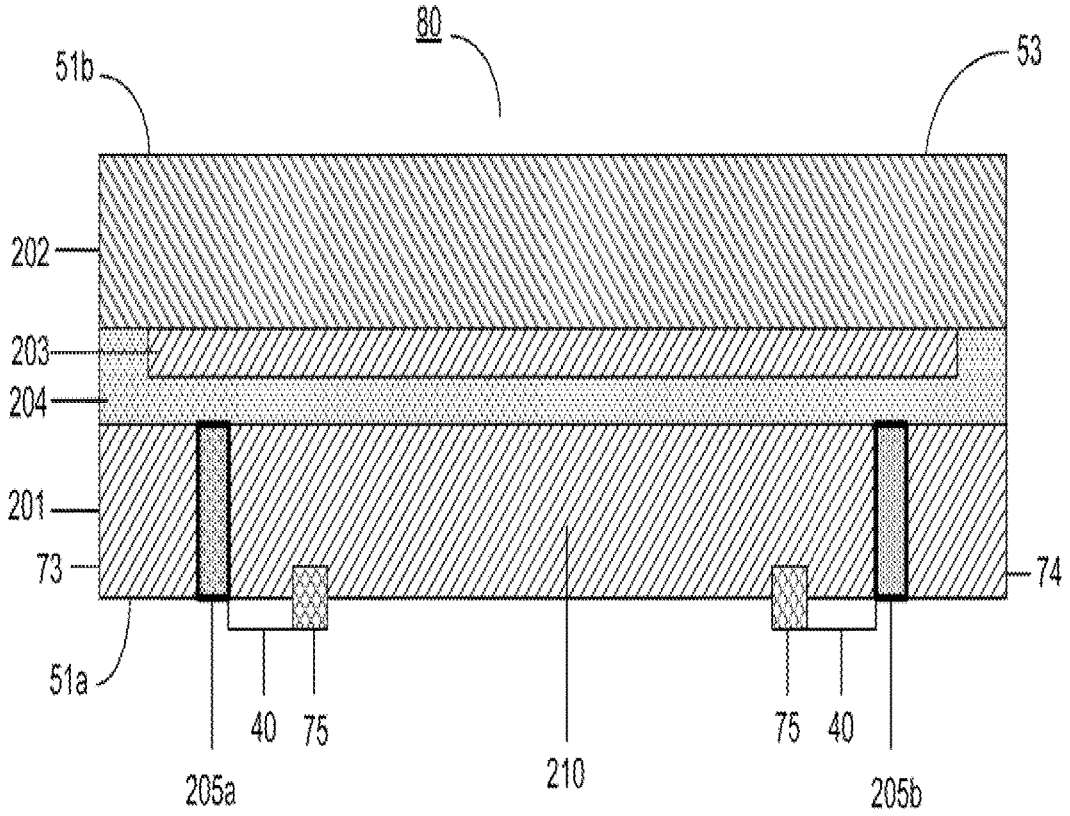
FIG. 6 depicts a cross-sectional view of a general embodiment of a thermoplastic overwrap of the present invention sealed to a tray and illustrating one embodiment of a pattern of perforations in a first film taken through section A-A of FIG. 5.
Figure 7:
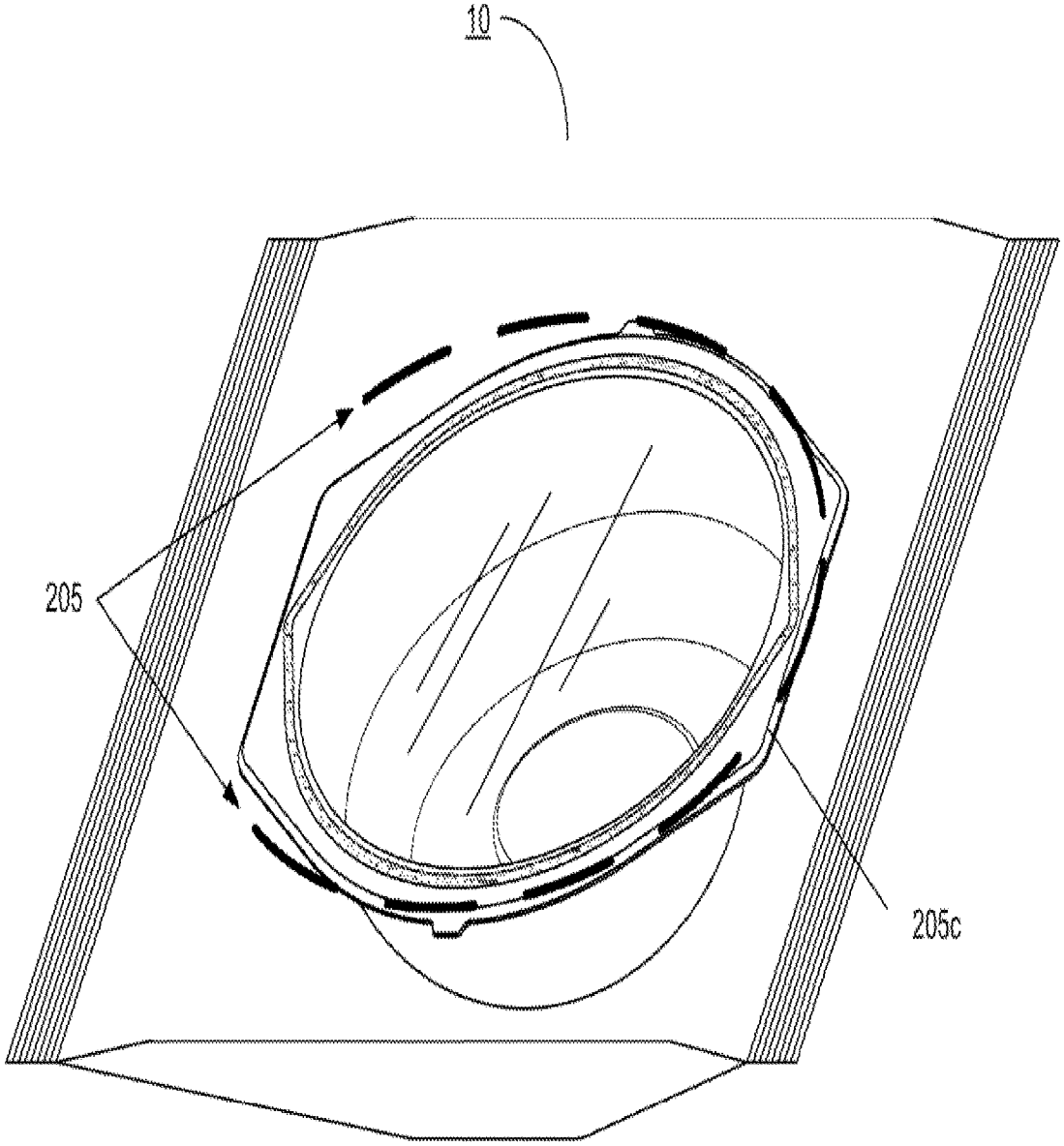
FIG. 7 depicts an isometric top perspective of a package of the present invention illustrating another embodiment of a pattern of perforations in a first film.
Figure 8:
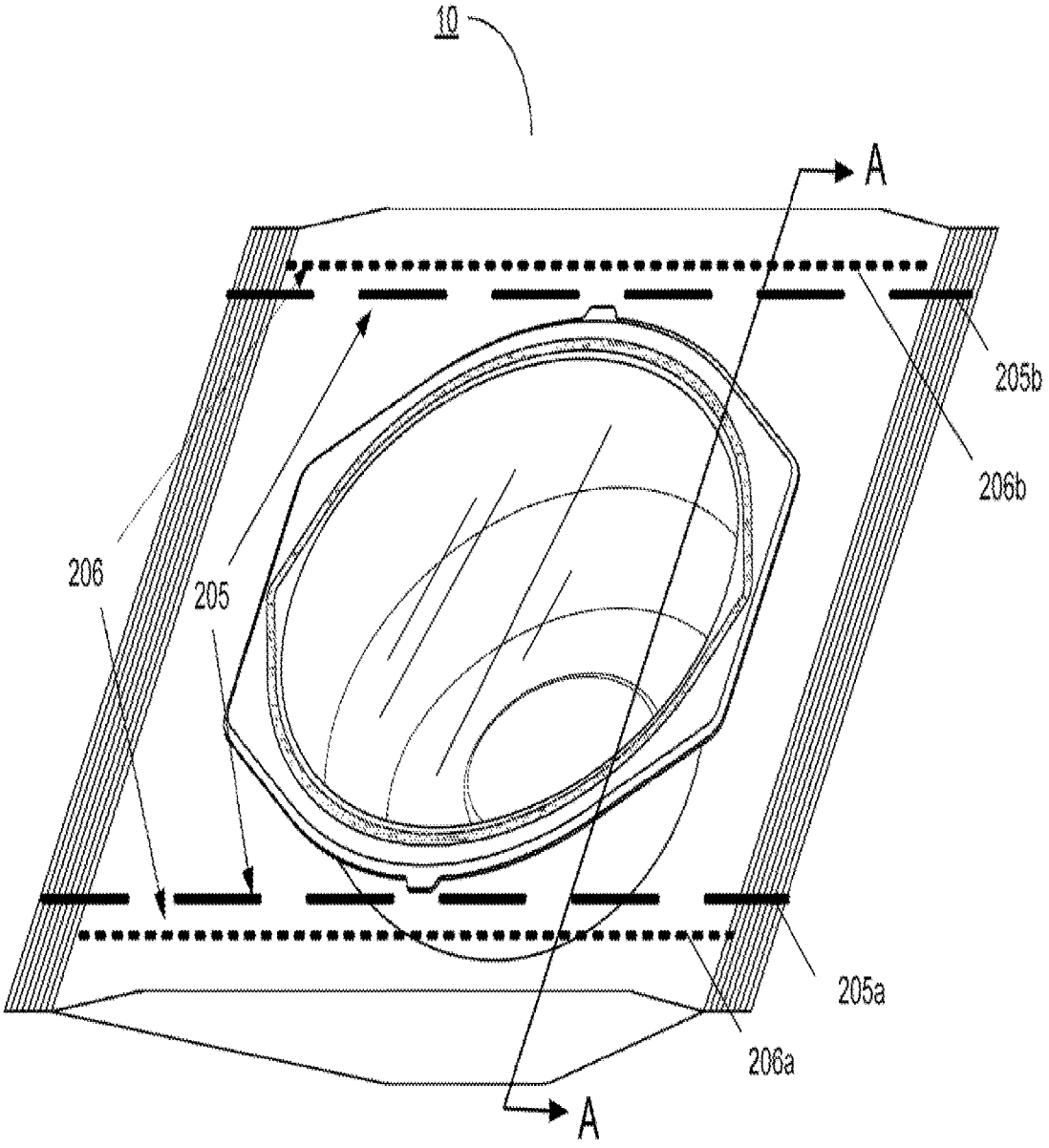
FIG. 8 depicts an isometric top perspective of a package of the present invention illustrating one embodiment of a pattern of perforations in a first film and one embodiment of a pattern of perforations in a second film

To facilitate the removal of tray 20 from overwrap 50, first film 201 may comprise a pattern of perforations 205 within first film 201 located between the peelable seal 75 and at least one of the first side edge 73, opposing second side edge 74, first leading end seal 71 or opposing second trailing end seal 72. Perforations may be formed as continuous, intermittent or a combination of continuous and intermittent segments of scoring, cutting or perforations. Pattern of perforations 205 may be formed by any mechanical and/or optical scoring, cutting or perforating methods known in the art. One example of a scoring technique which may be used to assist in the formation of perforations is optical ablation using a laser source. Laser scoring is well-known in the art. Preferably, pattern of perforations 205 has a depth of the entire thickness of first film 201. As illustrated in FIGS. 5 and 6, one embodiment of a pattern of perforations 205 (identified as bold dashed lines in FIGS. 6 and 7) comprises a first discrete linear line 205*a* positioned adjacent to said first side edge 73, and a second discrete linear line 205*b* positioned adjacent to said opposing second side edge 74. FIG. 7 illustrates another embodiment pattern of perforations 205 in first film 201 comprising a continuous line 205*c* substantially circumscribing said peelable seal 75.

Figure 9:
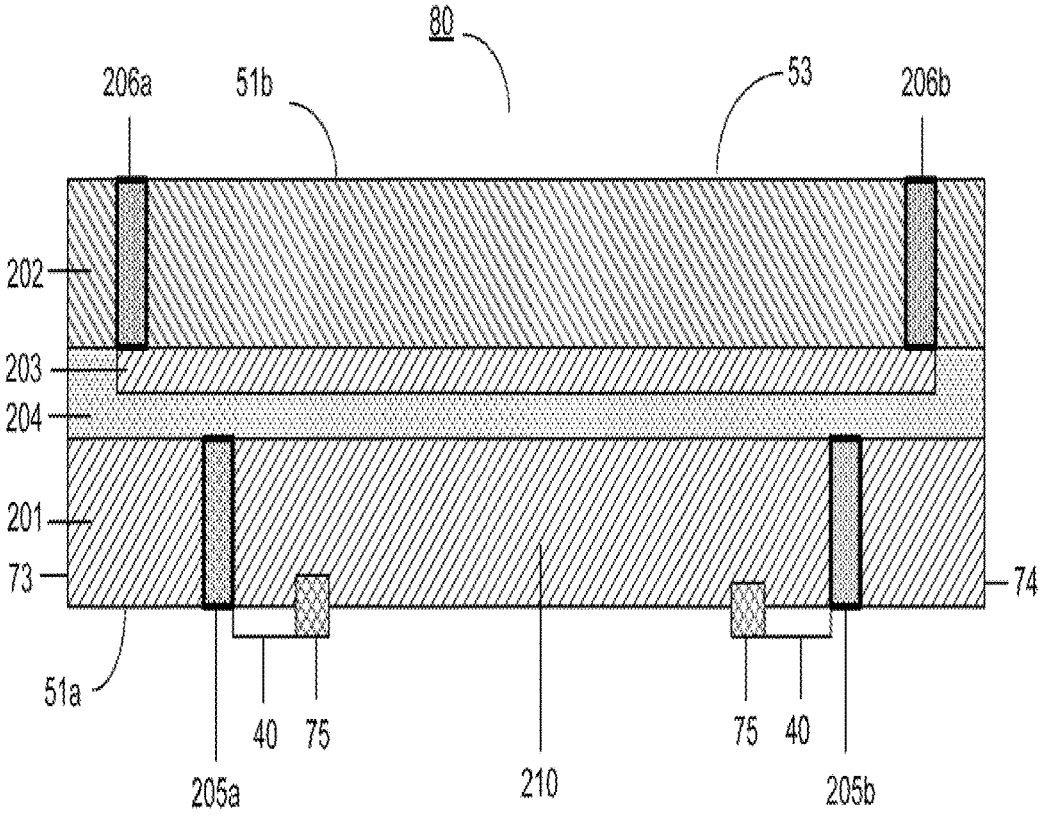
FIG. 9 depicts a cross-sectional view of a general embodiment of a thermoplastic overwrap of the present invention sealed to a tray and illustrating one embodiment of a pattern of perforations in a first film and one embodiment of a pattern of perforations in a second film taken through section A-A of FIG. 8.
Figure 10:
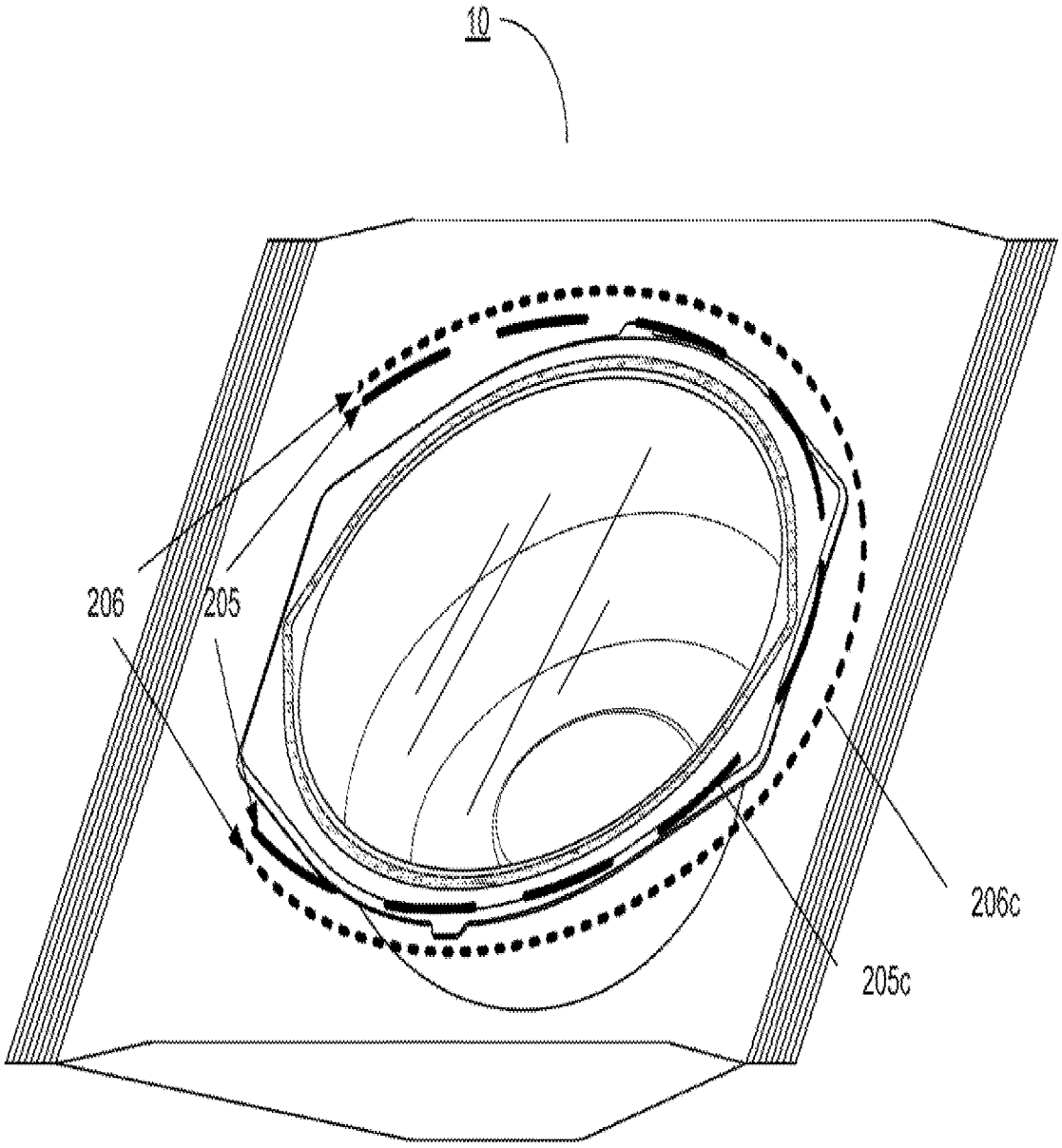
FIG. 10 depicts an isometric top perspective of a package of the present invention illustrating one embodiment of a pattern of perforations in a first film and one embodiment of a pattern of perforations in a second film.

To further assist in the opening of overwrap 50, there may be a pattern of perforations 206 within second film 202 in addition to pattern of perforations 205 within first film 201. Preferably, pattern of perforations 206 (identified as bold dotted lines in FIGS. 9 and 10) within second film 202 are also located between peelable seal 75 and at least one of first side edge 73, opposing second side edge 74, first leading end seal 71 or opposing second trailing end seal 72 as noted for pattern of perforations 205 in first film 201. Preferably, pattern of perforations 206 has a depth of the entire thickness of second film 202. As shown in FIGS, 8 and 9, one embodiment of a pattern of perforations 206 comprises a first discrete linear line 206*a* positioned adjacent to said first side edge 73, and a second discrete linear line 206*b* positioned adjacent to said opposing second side edge 74 in addition to the first and second discrete lines 205*a* and 205*b* in first film 201. FIG. 10 illustrates another embodiment pattern of perforations 206 in second film 202 comprising a continuous line 206*c* substantially circumscribing said peelable seal 75 in additional to the continuous line 205*c* in first film 201, In one embodiment, package 10 includes a pattern of perforations 205 in only first film 201 as depicted in FIG. 7. In another embodiment, package 10 includes a pattern of perforations 205 in first film 201 and a pattern of perforations 206 within second film 202 as depicted in FIG. 10.

Figure 11:
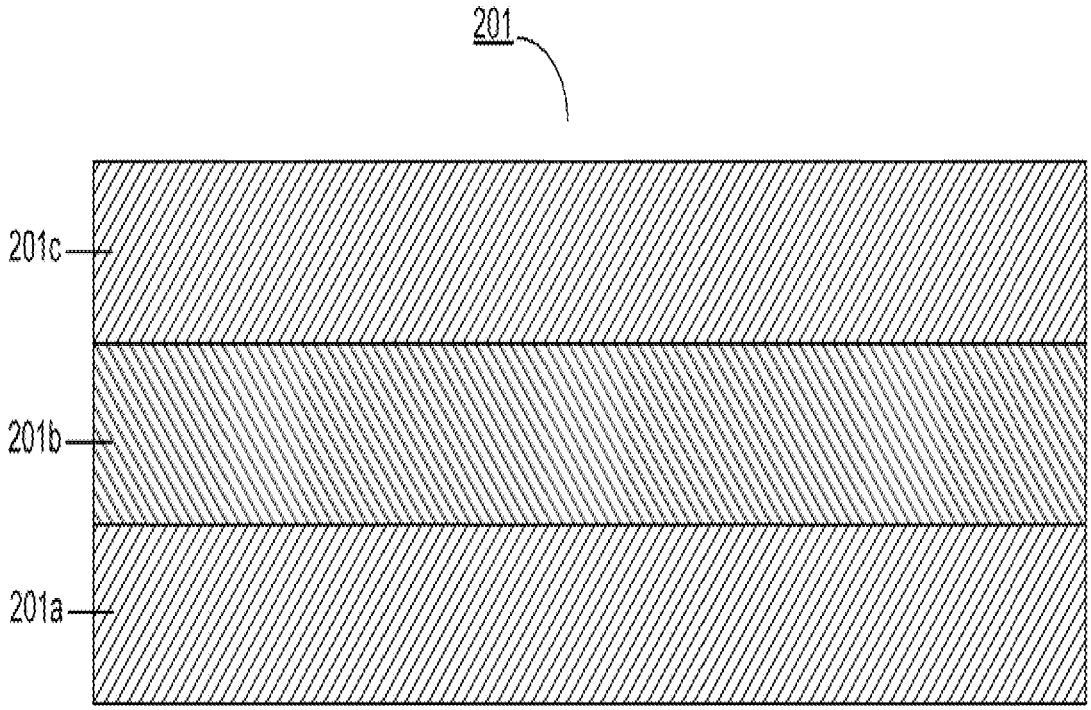
FIG. 11 depicts a cross-sectional view of one embodiment of a first film of the present invention.

In one embodiment, first film 201 is a multilayer film comprising any number of layers depending on the functional properties desired, First film 201 may comprise any polyolefin including, but not limited to, polyethylene, preferably, low density polyethylene, and more preferably, linear low density polyethylene, ethylene vinyl acetate copolymer, polypropylene or combinations thereof. In one embodiment, first film 201 is a three-layer film as illustrated in FIG. 11. Preferably, first film 201 comprises an exterior heat sealing layer 201*a*. Such exterior heat sealing layers may comprise ethylene/vinyl acetate copolymer or polypropylene. Preferably. first film 201 comprises a second layer 201*b* in contact with the exterior heat sealing layer comprising a blend of polybutene and a polyolefin. Suitable polyolefins include, but not are limited to ethylene/vinyl acetate copolymer and polyethylene. First film 201 may also comprise a third layer 201*c* in contact second layer 201*b*.

First film 201 may be formed by coextrusion of one or more polymeric materials by cast coextrusion or blown coextrusion techniques. Preferably, first film 201 is formed by blown coextrusion methods. The total thickness of first film 201 is generally from about 12.7 μm (0.5 mil) to about 254 μm (10 mil), typically from about 25.4 μm (1 mil) to about 127 μm (5 mil), most typically from about 50.8 μm (2 mil) to about 63.5 μm (2.5 mil).

Figure 12:
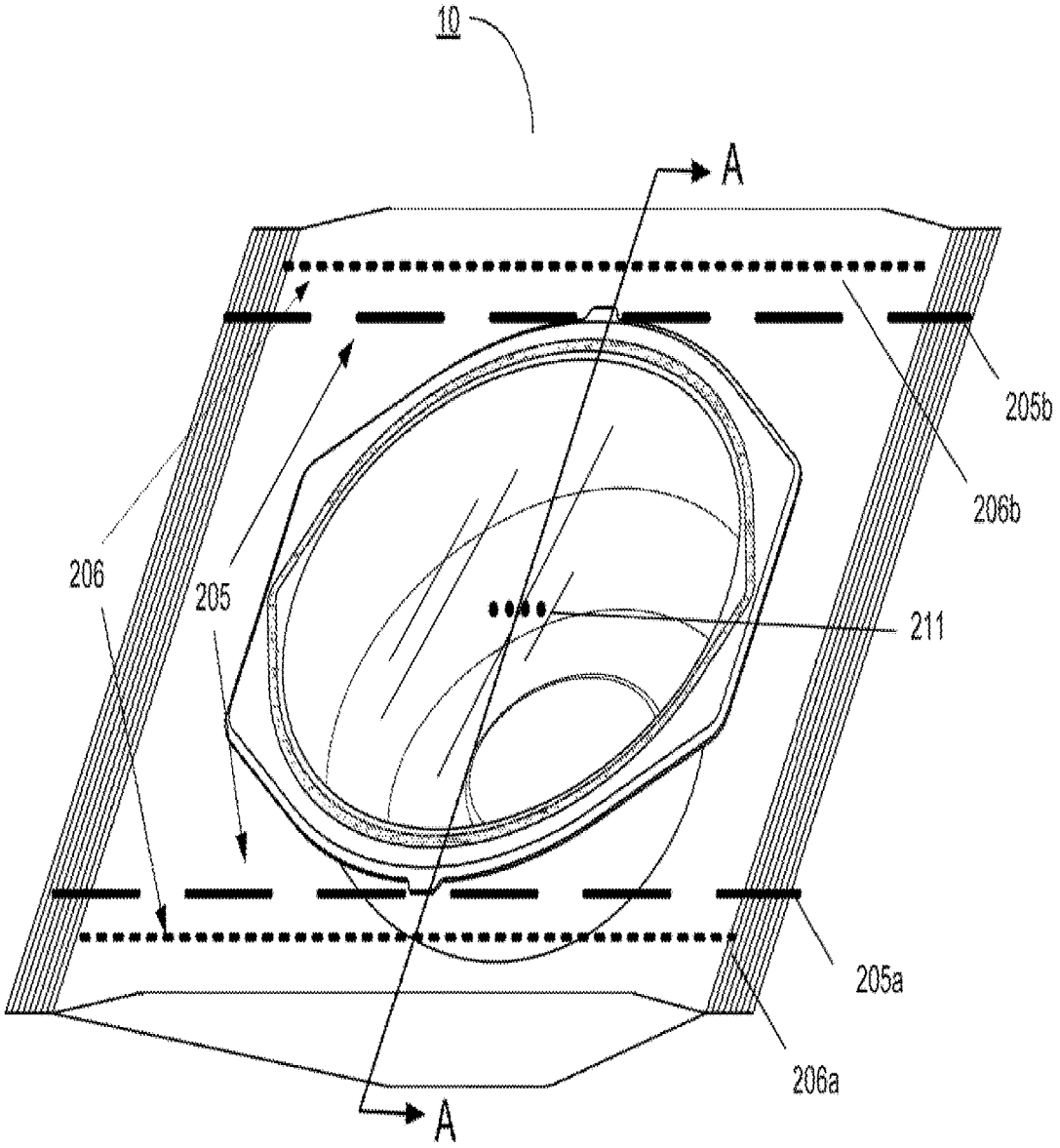
FIG. 12 depicts an isometric top perspective of one embodiment of a means for venting internal pressure from inside said package comprising a pattern of perforations.
Figure 13:
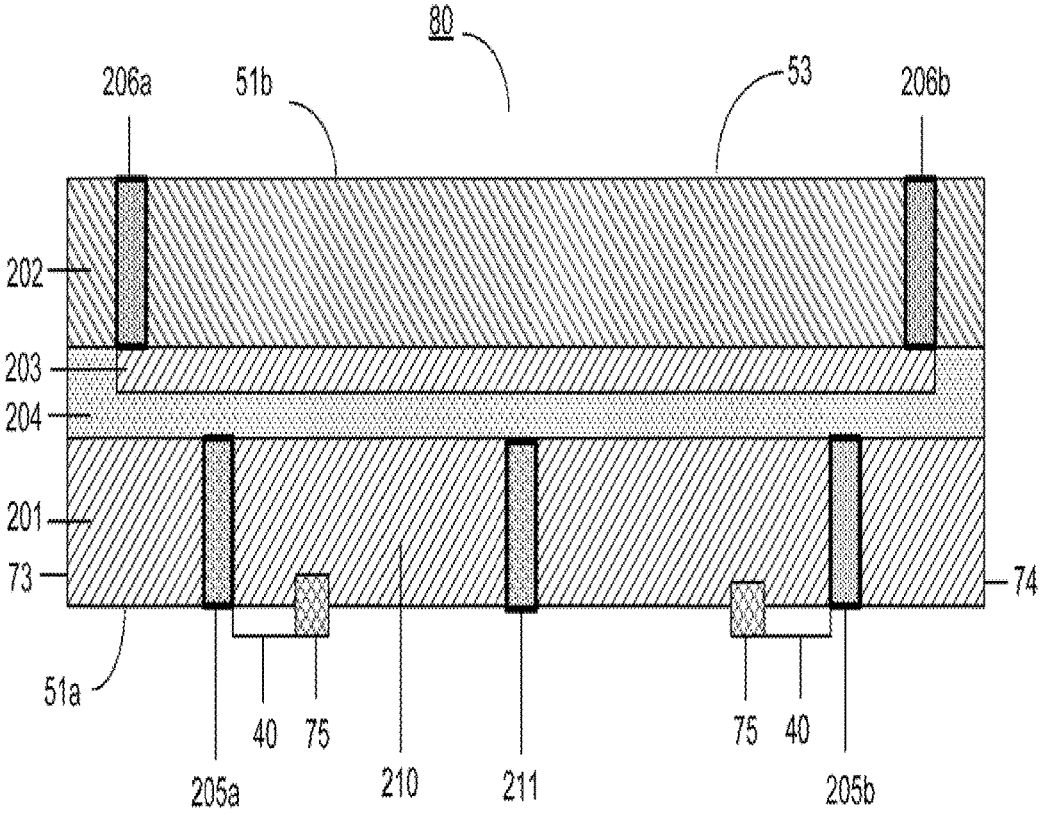
FIG. 13 depicts a cross-sectional view of one embodiment of a self-venting means taken through section A-A of FIG. 12.
Figure 14:
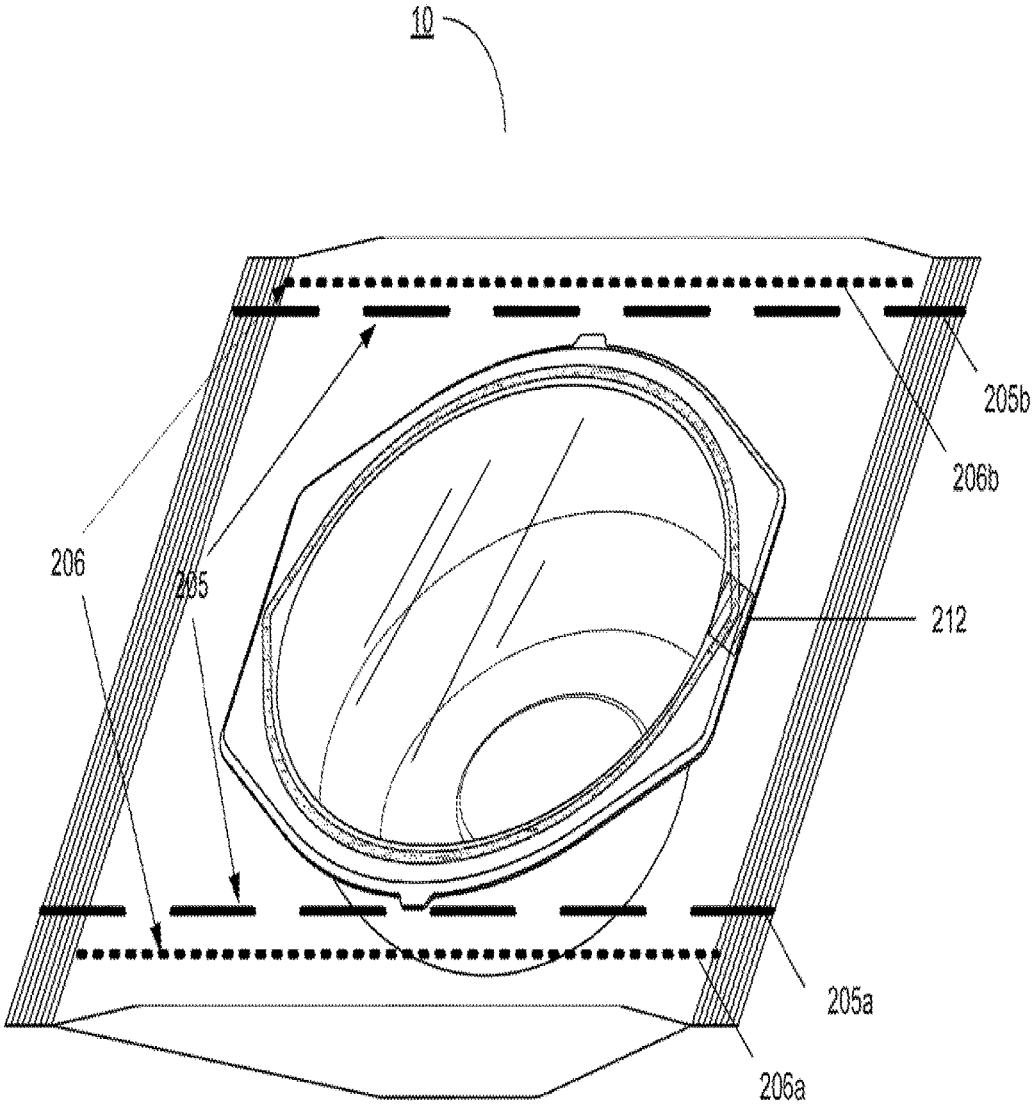
FIG. 14 depicts an isometric top perspective of another embodiment of a means for venting internal pressure from inside said package comprising a heat-sealable release coating applied to an area of the peelable heat seal.

Package 10 may further comprise a means for venting internal pressure from inside said package. One such means may include a pattern of perforations 211 having a depth of the entire thickness of the first film 201. Preferably, pattern of perforations 211 is located within portion of first film 201 which separates from the overwrap and remains peelably attached to the tray. Perforations may include one or more scored or cut segments within portion of first film 210 as illustrated in FIGS. 12 and 13. The number and size of the perforations may vary depending upon amount of internal pressure generated within the package. Another means for venting internal pressure may comprise a portion of the pee able seal comprising a heat-sealable release coating Preferably, a heat-sealable release coating 212 (shown in FIG. 14) is applied within a predetermined area of peelable seal 75 between the inner surface of the overwrap 51*a* and flange 40. Release coating 212 may comprise a solvent-based printable heat-sealable release coating. An example of a commercially available solvent-based printable heat-sealable release coating is PROXSEAL J9660MN supplied by Henkel Corporation (Cary, N.C.).

In a preferred embodiment, second film 202 comprises an oriented thermoplastic material. Examples of suitable oriented thermoplastic materials include, but are not limited to oriented polyethylene terephthalate, oriented polypropylene and oriented polyamide. Preferably, film 202 is oriented, more preferably, uniaxially oriented in either the machine direction or transverse direction and more preferably, biaxially oriented in both the machine direction and the transverse direction. Preferably, film 202 is a biaxially oriented polyethylene terephthalate film which is heat annealed to render the film substantially non-heat shrinkable, e.g., a film having a heat shrinkage of less than about 15%, more preferably, less than 10% and most preferably, less than 5% in either the machine and/or transverse direction. The total thickness of film 202 is generally from about 36 gauge to 142 gauge (or 9.14 microns to 36.10 microns), typically, from 42 gauge to about 92 gauge (or about 10.67 microns to about 23.37 microns).

In accordance with the present invention, first film 201 may be a multilayered film which includes oxygen barrier materials that provides an oxygen transmission rate of less than about 1.0 $cm^3/100\ in^2/24\ h$ at 73° F., 0% RH and 1 atm (or about 15.5 $cm^3/m^2/24\ h$ at 23° C., 0% RH and 1 atm), preferably, less than about 0.5 $cm^3/100\ in^2/24\ h$ at 73° F., 0% RH and 1 atm (or about 7.75 $cm^3/m^2/24\ h$ at 23° C., 0% RH and 1 atm), and most preferably, about 0.2 $cm^3/100\ in^2/24\ h$ at 73° F., 0% RH and 1 atm (or about 3.1 $cm^3/m^2/24\ h$ at 23° C., 0% RH and 1 atm). In accordance with the present invention, second film 201 includes water barrier materials, such as a polyolefin, particularly, polyethylene which provides a water vapor transmission rate less than about 1.0 g/100 in$^2$/24 h at 73° F., 90% RH and 1 atm (or about 15.5 g/m$^2$/24 h at 23° C., 90% RH and 1 atm) and preferably, about 0.2 g/100 in$^2$/24 h at 73° F., 90% RH and 1 atm (or about 3.1 g/m$^2$/24 h at 23° C., 90% RH and 1 atm). First film 201 may comprise both oxygen barrier materials and water barrier materials.

WORKING EXAMPLES

The following example illustrates a certain particular embodiment of a polymeric laminate suitable for use as an overwrap in the present invention and is not to be interpreted as limiting. In the following example, resin composition percentages are based on the total weight of each film layer.

Example 1

Example 1 is one embodiment of a polymeric laminate suitable for use as a thermoplastic overwrap of the present invention having a general structure 80 as illustrated in FIG. 3. In this example, first film 201 is a three-layer film which was adhesively laminated to a second film 202 via an adhesive layer 204. A release lacquer 203 is printed in-register (or non-contiguously) onto first film 201 such that release lacquer 203 is in direct contact with less than the entire surface of second film 202, First film 201 was formed by blown-film coextrusion methods. Second film 202 was purchased as free-standing film. In this example, first film 201 has thickness of about 2.0 mil and a structure and layer compositions as described below and as illustrated in FIG. 11. Reported below is the basis weight of the layer relative to the total film weight and the layer composition.

Layer 1 (Sealant): 5%; 100 wt.- % ethylene/vinyl acetate copolymer (EVA)-Petrothene NA442 having a5% vinyl acetate content (Equistar Chemicals, LP, Houston, Tex., USA)

Layer 2: 5%; 83 wt.- % ethylene/vinyl acetate copolymer (EVA)-Petrothene NA442 having a5% vinyl acetate content (Equistar Chemicals, LP, Houston, Tex., USA) and 17 wt.- % polybutene (PB)-polybutene-1 PB 8640M having a random copolymer of butene-1 and low ethylene content (LyondellBasell Industries Holdings, B.V., The Netherlands)

Layer 3: 90%; 60 wt.- % ultra low-density polyethylene (ULDPE)-ATTANE® 4701 copolymer supplied by Dow Chemical Company, Midland, Mich.), 35 wt.- % linear low density polyethylene ExxonMobil™ LLDPE 1001.32 (ExxonMobil Chemical Company, Houston, Tex.), and 5% processing additives.

A release lacquer 203 was printed in-register (or non-contiguously) on first film 201. If the release lacquer is a solvent-borne material, it is then dried through a drying oven. Following the application of the release lacquer, first film 201 is then scored, cut and/or perforated to provide the pattern of perforations in the first film. A reverse printed 48 gauge mono-layer second film 202 was then bonded with a laminating adhesive 203 to the lacquered first film 201 The mono-layer second film 202 was a biaxially oriented polyethylene terephthalate (OPET) free-standing substrate (SKYRO® SP65 supplied by SKC, Inc., Covington, Ga.). After the lamination has been completed, the second film 202 is then scored, cut and/or perforated to provide the pattern of perforations in the second film.

After formation of the overwrap, the tray may then be filled with a food product and the overwrap placed over the tray and sealed to the flange of the tray. Preferably, overwrap is sealed to the tray such that a continuous seal is formed circumscribing the perimeter of the recessed cavity Preferably, the overwrap is sealed as a heat seal. Heat sealing can be achieved by bringing the surface of the overwrap into contact the surface of the flange and then applying sufficient heat and pressure to a predetermined area of the two surfaces to cause the contacting surfaces to become molten and intermix with one another, thereby forming as essentially inseparable fusion bond between the two surfaces in the predetermined area when the heat and pressure are removed therefrom and the area is allowed to cool. In one embodiment, the heat seal of the overwrap to the flange of the tray is a non-hermetic heat seal. In another embodiment, the heat seal of the overwrap to the flange of the tray is a hermetic heat seal. Once the overwrap is sealed to the flange of the tray, the overwrap is folded around the tray and a longitudinal seal is formed underneath the base of the tray. Preferably, the longitudinal seal is configured as a fin seal. Alternatively, the longitudinal seal can be configured as a lap seal. Sealing the overwrap underneath the base of the tray forms the front panel and the opposing back panel of the package. It is preferred to form the longitudinal seal as a heat seal.

After forming the longitudinal seal, a first leading end seal positioned substantially transverse to the longitudinal seal and an opposing second trailing end seal positioned substantially transverse to the longitudinal seal are then formed. Preferably, each of the end seals are formed as fin seals by heat sealing the inner surfaces of the front and back panels together which extend beyond the perimeter of the tray. After the end seals are formed, the leading end and trailing end of the overwrap are cut to individualize each package.

In an alternative method, the overwrap is first folded around the tray and a longitudinal seal is formed underneath the base of the tray. After forming the longitudinal seal, a first leading end seal positioned substantially transverse to the longitudinal seal and an opposing second trailing end seal positioned substantially transverse to the longitudinal seal are then formed. Following formation of the ends seal, the overwrap is then heat sealed to the flange of the tray. The heat sealing of the overwrap to the tray flange may be accomplished such a manner known to those skilled in the art so that either a hermetic or non-hermetic heat seal is formed.

Once package has been individualized, a separate label-type pull-tab may then be adhesively applied to the removable portion of the package at a location near or on a line of weakness. Preferably, the pull-tab is placed at a location which generally corresponds to the mid-point on the line of weakness. The pull-tab may have at least a first edge which is permanently affixed to the removable portion of the front panel. The pull-tab may further have an opposing second edge which is peelably affixed to the front panel of the package.

The invention claimed is:

1. A package comprising;

a rigid or semi-rigid tray having a base and at least one sidewall extending from said base thereby forming a recessed cavity; wherein said at least one sidewall comprises a peripheral flange extending generally perpendicularly from said at least one sidewall and circumscribing said recessed cavity;

a single thermoplastic overwrap surrounding said base and at least one sidewall of said tray and comprising a peelable polymeric laminate; wherein said overwrap comprises a first side edge, an opposing second side edge, a front panel and an opposing back panel comprising a longitudinal seal, a first leading end seal positioned substantially transverse to said longitudinal seal, an opposing second trailing end seal positioned substantially transverse to said longitudinal seal; wherein said front panel comprises an inner surface and an outer surface;

a first film integrally formed in said laminate; wherein said first film forms said inner surface of said front panel;

a second film integrally formed in said laminate; wherein said second film forms said outer surface of said front panel;

a continuous peelable seal circumscribing said recessed cavity defined by a heat seal formed by heat sealing a portion of said front panel to said peripheral flange; and a portion of said first film that separates from said laminate and remains peelably sealed to said flange when said tray is removed from said overwrap.

2. The package according to claim 1, wherein said first film comprises a pattern of perforations within said first film located between said peelable seal and at least one of said first side edge, said opposing second side edge, said first leading end seal or said opposing second trailing end seal.

3. The package according to claim 2, wherein said pattern of perforations comprises a first discrete linear line positioned adjacent to said first side edge, and a second discrete linear line positioned adjacent to said opposing second side edge.

4. The package according to claim 2, wherein said pattern of perforations is a continuous line substantially circumscribing said peelable seal.

5. The package according to claim 2, wherein said pattern of perforations has a depth of the entire thickness of said first film.

6. The package according to claim 1, wherein said second film comprises a pattern of perforations within said second film located between said peelable seal and at least one of said first side edge, said opposing second side edge, said first leading end seal or said opposing second trailing end seal.

7. The package according to claim 6, wherein said pattern of perforations comprises a first discrete linear line positioned adjacent to said first side edge, and a second discrete linear line positioned adjacent to said opposing second side edge.

8. The package according to claim 6, wherein said pattern of perforations is a continuous line substantially circumscribing said peelable seal.

9. The package according to claim 6, wherein said pattern of perforations has a depth of the entire thickness of said second film.

10. The package according to claim 1, wherein said first film comprises an exterior heat sealing layer.

11. The package according to claim 10, wherein said exterior heat sealing layer comprises ethylene vinyl acetate copolymer or polypropylene.

12. The package according to claim 10, wherein said first film comprises a layer in contact with said exterior heat sealing layer comprising a blend of polybutene and ethylene vinyl acetate copolymer.

13. The package according to claim 1, wherein said first film comprises a means for venting internal pressure from inside said package.

14. The package according to claim 13, wherein said means for venting internal pressure comprises a pattern of perforations having a depth of the entire thickness of said first film.

15. The package according to claim 13, wherein said means for venting internal pressure comprises a portion of said peelable seal comprising a heat-sealable release coating.

16. The package according to claim 1, wherein said first film comprises an oxygen barrier material.

17. The package according to claim 1, wherein said second film comprises an exterior layer of oriented polyethylene terephthalate, oriented polypropylene or oriented polyamide.

18. The package according to claim 17, wherein said laminate comprises a layer of release lacquer in contact with a portion of said exterior layer of said second film.

19. The package according to claim 18, wherein said laminate comprises a layer of adhesive in contact with said layer of release lacquer and said first film.

20. The package according to claim 1, wherein said package is a microwavable package.

* * * * *